US010321749B2

(12) United States Patent
Harness

(10) Patent No.: US 10,321,749 B2
(45) Date of Patent: Jun. 18, 2019

(54) BOARD CARRIER

(71) Applicant: Greg L. Harness, Los Angeles, CA (US)

(72) Inventor: Greg L. Harness, Los Angeles, CA (US)

( * ) Notice: Subject to any disclaimer, the term of this patent is extended or adjusted under 35 U.S.C. 154(b) by 0 days.

(21) Appl. No.: 15/903,289

(22) PCT Filed: Aug. 25, 2016

(86) PCT No.: PCT/IB2016/055087
§ 371 (c)(1),
(2) Date: Feb. 23, 2018

(87) PCT Pub. No.: WO2017/033151
PCT Pub. Date: Mar. 2, 2017

(65) Prior Publication Data

US 2018/0206621 A1 Jul. 26, 2018

Related U.S. Application Data

(60) Provisional application No. 62/209,611, filed on Aug. 25, 2015.

(51) Int. Cl.

| | |
|---|---|
| ***A45F 3/02*** | (2006.01) |
| ***A45F 5/10*** | (2006.01) |
| ***A45F 3/15*** | (2006.01) |
| ***A45F 3/14*** | (2006.01) |

(52) U.S. Cl.
CPC ..... *A45F 3/15* (2013.01); *A45F 3/14* (2013.01); *A45F 5/10* (2013.01); *A45F 2003/142* (2013.01); *A45F 2005/1006* (2013.01); *A45F 2005/1013* (2013.01); *A45F 2200/05* (2013.01)

(58) Field of Classification Search
CPC ..... A45F 2005/1013; A45F 3/14; A45F 3/15; A45F 5/10; A45F 2003/142; A45F 2005/1006; A45F 2200/05
See application file for complete search history.

(56) References Cited

U.S. PATENT DOCUMENTS

| | | | | | |
|---|---|---|---|---|---|
| 135,530 | A * | 2/1873 | Dunham | ..... | A45F 5/10 294/154 |
| 4,402,542 | A * | 9/1983 | Kreutzer | ..... | A45F 5/10 294/156 |
| 4,458,933 | A * | 7/1984 | Thomas | ..... | B65G 7/12 294/137 |
| 4,483,380 | A * | 11/1984 | Beran | ..... | A45C 3/00 206/315.1 |

(Continued)

*Primary Examiner* — Adam J Waggenspack

(57) ABSTRACT

A board carrier that allows an individual to readily carry a surfboard, paddle board, etc. has a carrier body and a retention strap used in conjunction to encompass the board. The carrier body has a central section that is positioned along an edge of the board, and a first flap and a second flap that are positioned on opposite sides of the board. A handle and a carrier strap are connected to the central section, providing a dual means of carrying the board. The retention strap is fixed to the first flap and removably engaged with a strap fastener that is connected to the second flap. The retention strap is positioned around the board and engaged with the strap fastener to secure the board carrier to the board. A plurality of grips is integrated into the carrier body and the retention strap to prevent the board from slipping.

11 Claims, 10 Drawing Sheets

(56) References Cited

U.S. PATENT DOCUMENTS

| | | | | | |
|---|---|---|---|---|---|
| 4,553,779 | A * | 11/1985 | Shortridge | A63C 11/025 | 224/917 |
| 4,804,025 | A * | 2/1989 | Bear | A45F 3/14 | 224/258 |
| 5,274,927 | A * | 1/1994 | Arnt | F41B 5/14 | 124/88 |
| 8,672,135 | B1 * | 3/2014 | Hymack | A47J 47/14 | 206/542 |
| 8,746,769 | B2 * | 6/2014 | Owen | A63C 11/021 | 224/917 |
| 8,905,275 | B1 * | 12/2014 | Klein | A63C 11/025 | 224/250 |
| 2005/0184118 | A1 * | 8/2005 | Vella | A45F 3/02 | 224/625 |
| 2014/0126230 | A1 * | 5/2014 | Harris | A45C 13/30 | 362/382 |

* cited by examiner

BOARD CARRIER

The current application is a 371 of international Patent Cooperation Treaty (PCT) application PCT/US2016/055087 filed on Aug. 25, 2016. The PCT application PCT/US2016/055087 claims priority to the U.S. Provisional Patent application Ser. No. 62/209,611 filed on Aug. 25, 2015.

FIELD OF THE INVENTION

The present invention relates generally to surfboard accessories. More specifically, the present invention is a board carrier that is designed to carry a surfboard more easily and more comfortably.

BACKGROUND OF THE INVENTION

Surfers have been carrying their surfboards under their arms for decades now. However, the carrying of a surfboard from its point of storage, or from an automobile to the surf, presents a problem due to the size and unwieldy nature of the board. The board can often slip out from underneath the user's arm, thus requiring the user to constantly readjust the board while walking. While devices has been designed to assist in carrying surfboards, such devices are often unwieldy and complicated to attach. Furthermore, they do not prevent the board from slipping and becoming displaced.

Therefore it is an object of the present invention to provide a device that can be quickly, easily and adjustably fitted on a surfboard and that is just as easily removed therefrom when required. It is another object of the present invention to provide a device by which the board can be carried in hand by the user in a convenient manner despite the size and weight of the board. The present invention provides a carrier body and a retention strap that are used in tandem to encompass a surfboard. A handle and a carrier strap are connected to the carrier body and allow the user to carry the surfboard in a balanced, comfortable manner, to thereby conveniently transport the board to or from the surf. Furthermore, a plurality of grips is integrated into the carrier body and the retention strap to prevent the board from slipping out while in transport.

DETAIL DESCRIPTIONS OF THE INVENTION

Figure 1:
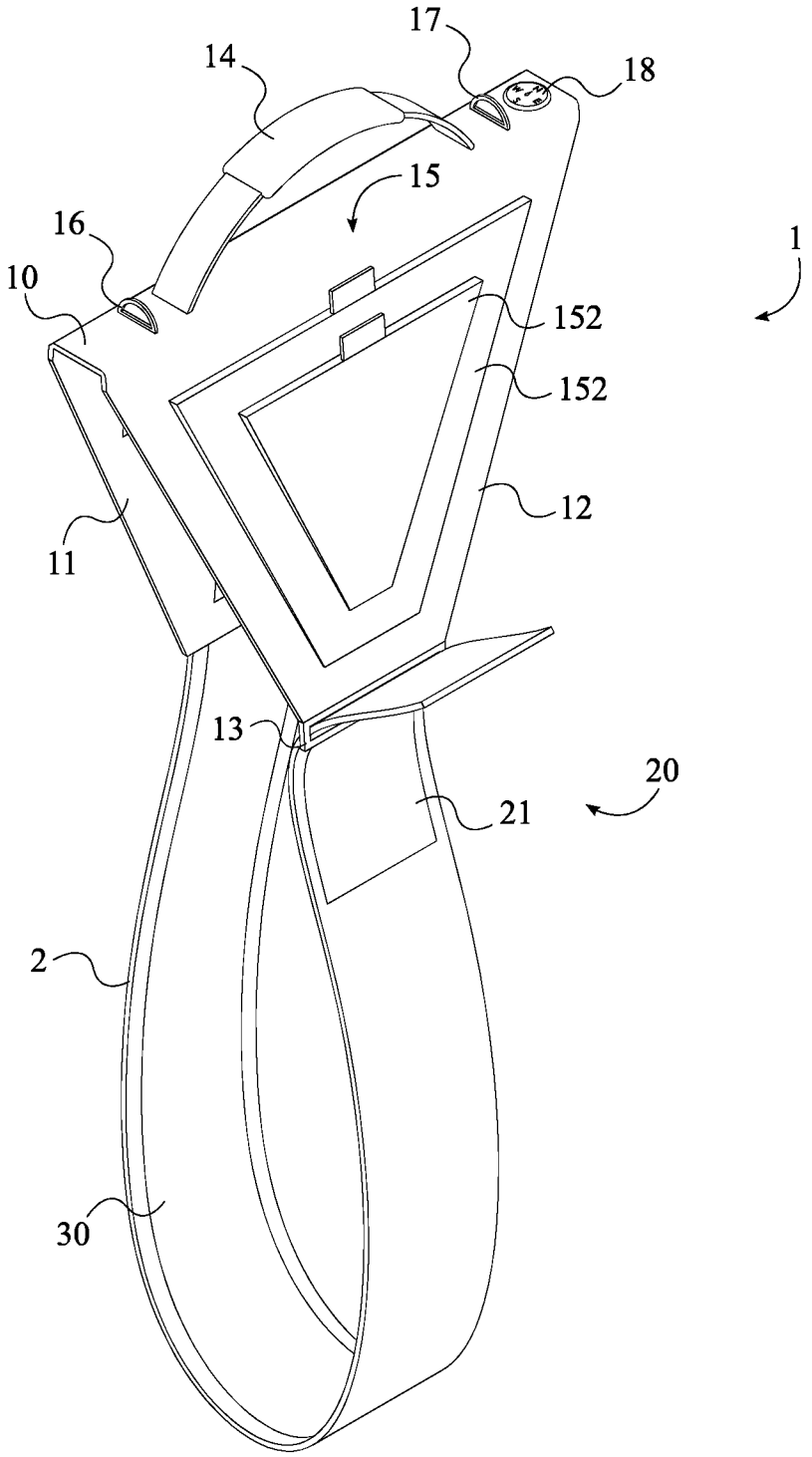
FIG. 1 is a perspective view of the present invention, wherein the retention strap is positioned through the strap fastener.

All illustrations of the drawings are for the purpose of describing selected versions of the present invention and are not intended to limit the scope of the present invention.

The present invention is a board carrier that allows an individual to readily carry a surfboard, paddle board, etc. The present invention comprises a carrier body 1, a retention strap 2, a plurality of grips 3, an extension strap 5, and a carrier strap 4. The carrier body 1 wraps around the edge of the board that is to be carried and provides terminal mounting for the retention strap 2. The retention strap 2 extends around the edge of the board opposite the carrier body 1, wherein the board is encircled by the carrier body 1 and the retention strap 2. The extension strap 5 can be used in conjunction with the retention strap 2 for wider boards.

Figure 2:
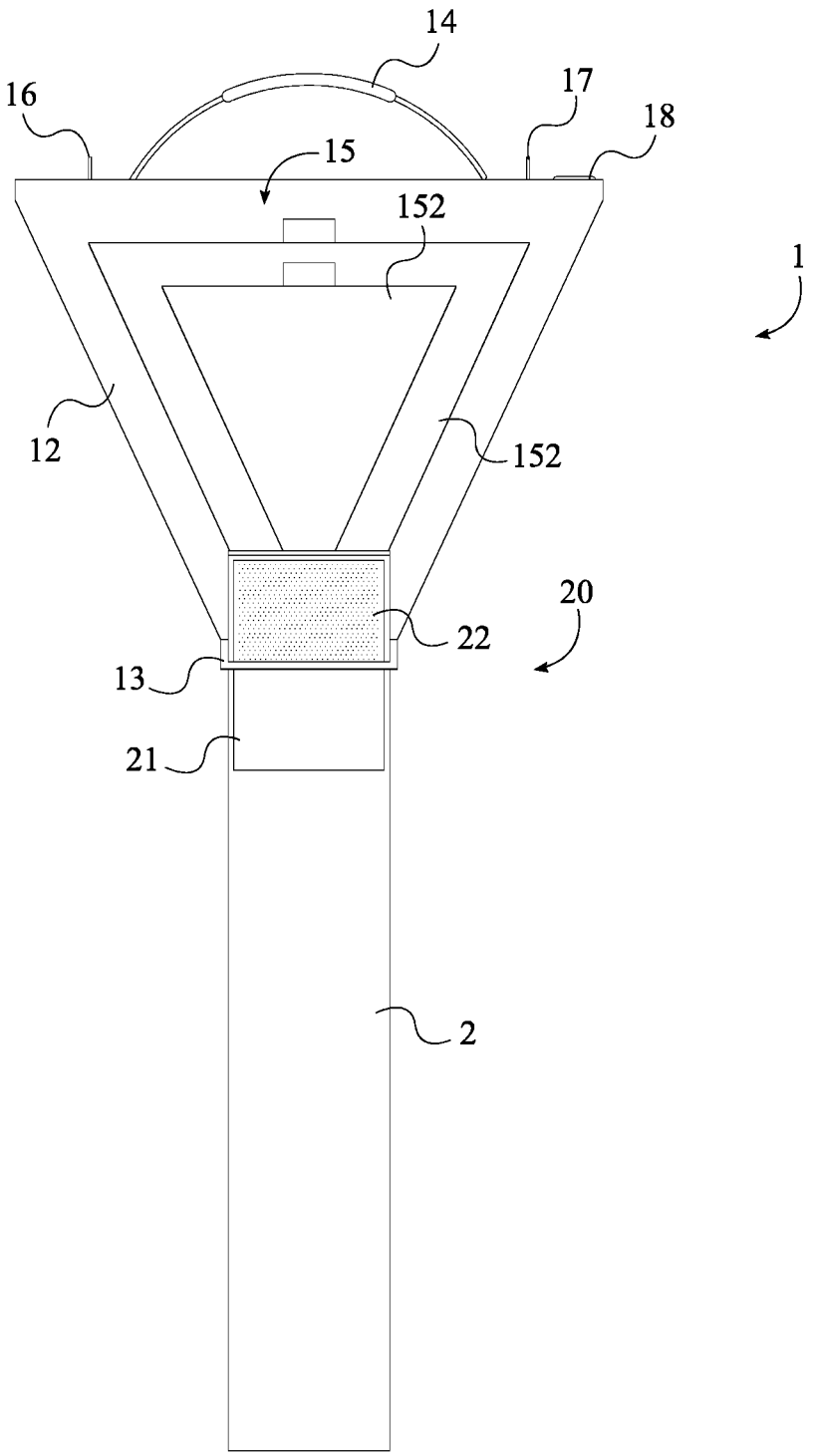
FIG. 2 is a right side elevational view detailing the hook portion and the loop portion of the fastener of the retention strap.
Figure 3:
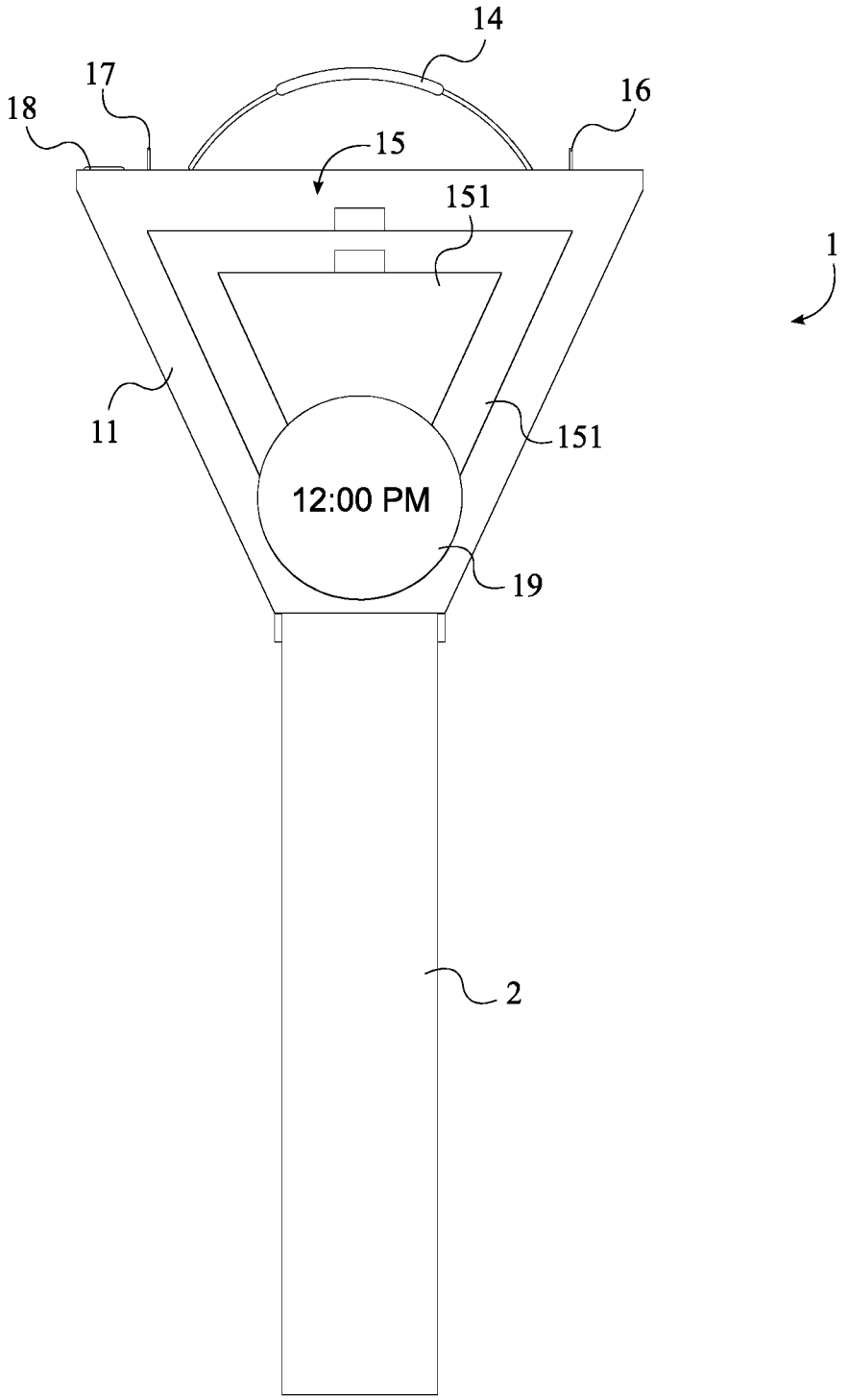
FIG. 3 is a left side elevational view detailing the media unit.

In reference to FIG. 1-3, the carrier body 1 comprises a central section 10, a first flap 11, a second flap 12, a strap fastener 13, a handle 14, and a plurality of pockets 15. The central section 10 is the portion of the carrier body 1 that is positioned along the edge of the board when the present invention is used to carry the board. As such, the central section 10 is an elongated section of material having a relatively small width. The first flap 11 and the second flap 12 are adjacently connected to the central section 10, wherein the central section 10 is positioned in between the first flap 11 and the second flap 12. In this way, the first flap 11 and the second flap 12 extend down along opposing sides of the board when the central section 10 is positioned along the edge of the board.

The retention strap 2 is terminally connected to the first flap 11 opposite the central section 10 as depicted in FIG. 3, while the strap fastener 13 is adjacently connected to the second flap 12 opposite the central section 10 as depicted in FIG. 2. The retention strap 2 is configured to removably engage with the strap fastener 13 such that the retention strap 2 can be positioned around the board and temporarily anchored to the second flap 12. The retention strap 2 can readily be engaged or disengaged from the strap fastener 13 in order to secure or remove both the carrier body 1 and the retention strap 2 from the board.

Figure 4:
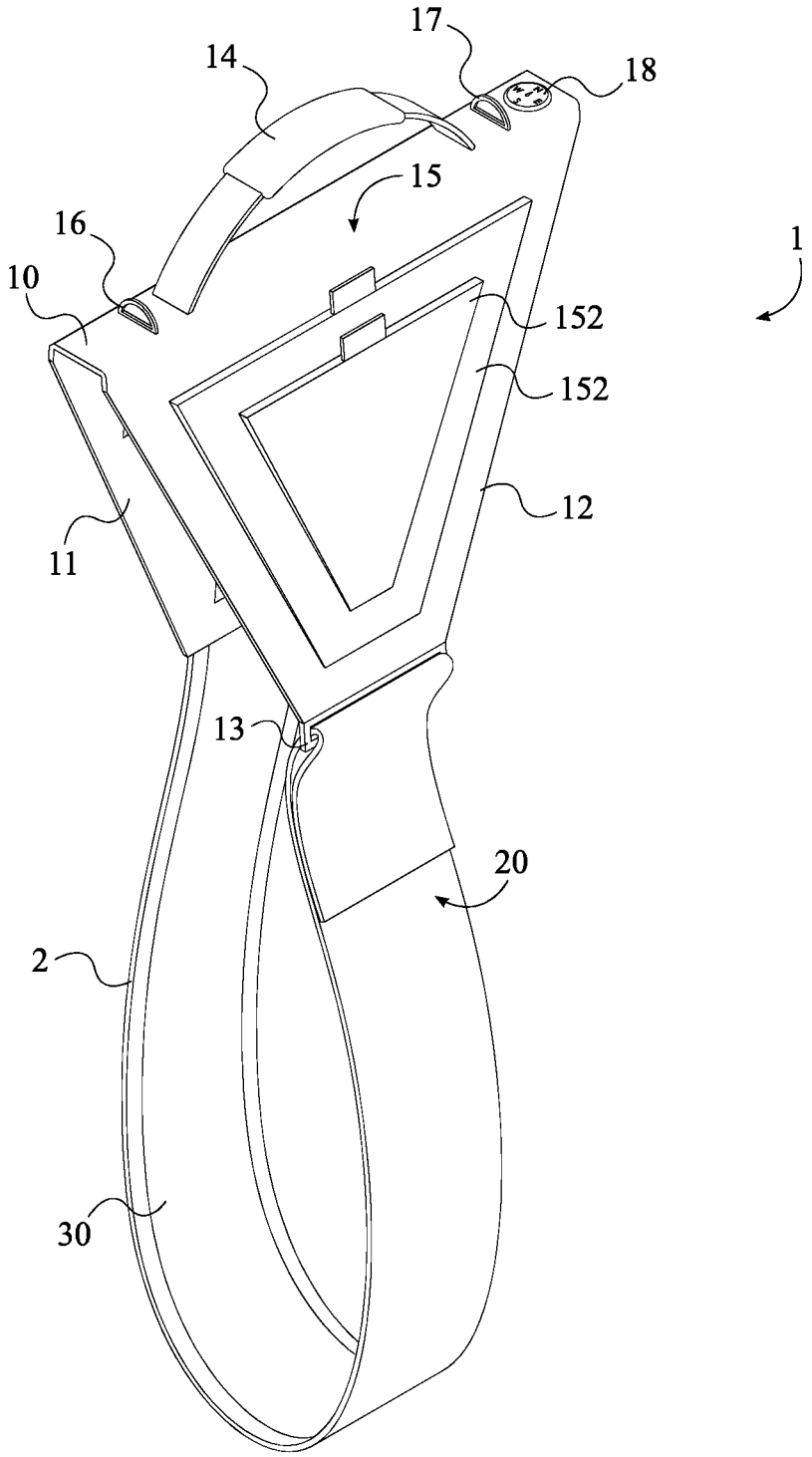
FIG. 4 is a perspective view wherein the hook portion is engaged with the loop portion in order to secure the retention strap to the strap fastener.

The retention strap 2 comprises a fastener 20 that is configured to removably secure the retention strap 2 to the strap fastener 13. In the preferred embodiment of the present invention, the fastener 20 is a hook and loop fastener, comprising a hook portion 21 and a loop portion 22; the hook portion 21 and the loop portion 22 being positioned adjacent to each other along an exterior side of the retention strap 2 as depicted in FIG. 2. Meanwhile, the strap fastener 13 is a loop through which the retention strap 2 can be positioned. When the retention strap 2 is positioned through the strap fastener 13, the hook portion 21 may be engaged with the loop portion 22 as depicted in FIG. 4, securing the retention strap 2 to the strap fastener 13 and in turn the second flap 12.

In other embodiments of the present invention, the fastener 20 and the strap fastener 13 may form other mechanical connections used to secure the retention strap 2 to the second flap 12. For example, the fastener 20 and the strap fastener 13 could be opposing snap fasteners, a button and a receiving slot, or a zipper connection. Any other suitable mechanical fastening means formed by the fastener 20 and the strap fastener 13 can also be employed in other embodiments of the present invention. Furthermore, a magnetic fastening means may be employed, wherein the fastener 20 and the strap fastener 13 are magnets being arranged to magnetically attract each other.

Figure 7:
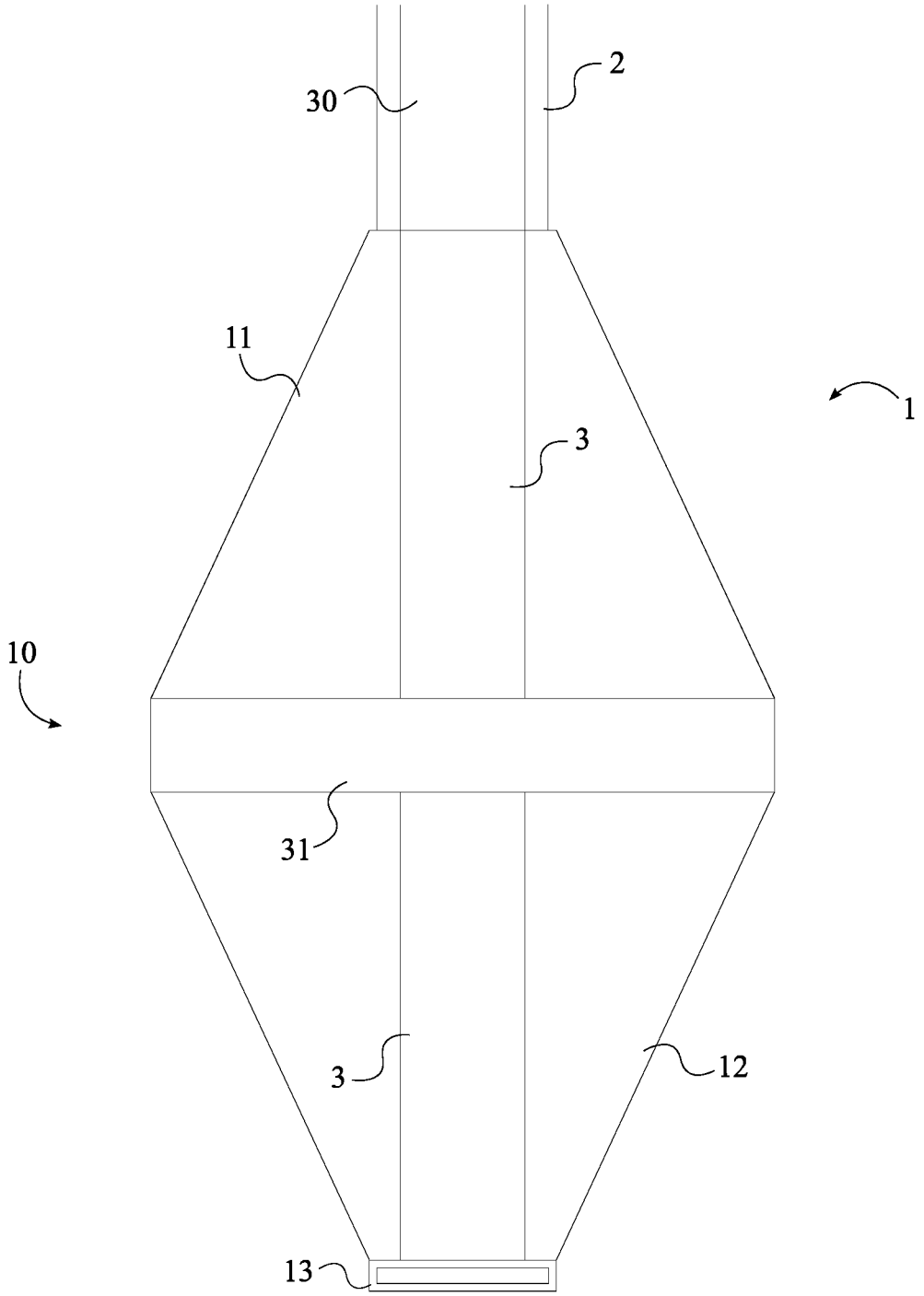
FIG. 7 is a bottom plan view of the carrier body and the retention strap, detailing the plurality of grips.

The plurality of grips 3 is integrated into the carrier body 1 and the retention strap 2, wherein each of the plurality of grips 3 is configured to engage with the board. More specifically, the plurality of grips 3 is integrated into an interior surface of both the carrier body 1 and the retention strap 2. In reference to FIG. 7, the plurality of grips 3 comprises a strap grip 30 and a carrier grip 31; the strap grip 30 being integrated with the retention strap 2 and the carrier grip 31 being integrated with the carrier body 1. More specifically, the strap grip 30 is positioned along the interior surface of the retention strap 2, such that the strap grip 30 engages with the board. Similarly, the carrier grip 31 is positioned about the interior surface of the carrier body 1, such that the carrier grip 31 engages with the board.

The carrier grip 31 comprises a first grip section, a second grip section, and a third grip section. The first grip section is positioned about the first flap 11, the second grip section is positioned about the second flap 12, and the third grip section is positioned along the central section 10. In this way, the carrier grip 31 provides a gripping surface for each side of the carrier body 1, such that the carrier body 1 can be securely engaged with the board about all sides.

The handle 14 is adjacently connected to the central section 10 opposite the plurality of grips 3. The handle 14 is terminally connected to the central section 10 about two points on opposing ends of the central section 10. In this way, the handle 14 extends along the central section 10, and in turn the edge of the board when the carrier body 1 and the retention strap 2 are attached to the board. The handle 14 allows a user to readily lift and transport the board, while the plurality of grips 3 prevents the board from slipping out of the carrier body 1 and the retention strap 2 when the board is lifted using the handle 14. Furthermore, the handle 14 comprises a padded section to increase the comfort of the user when carrying the board.

Figure 5:
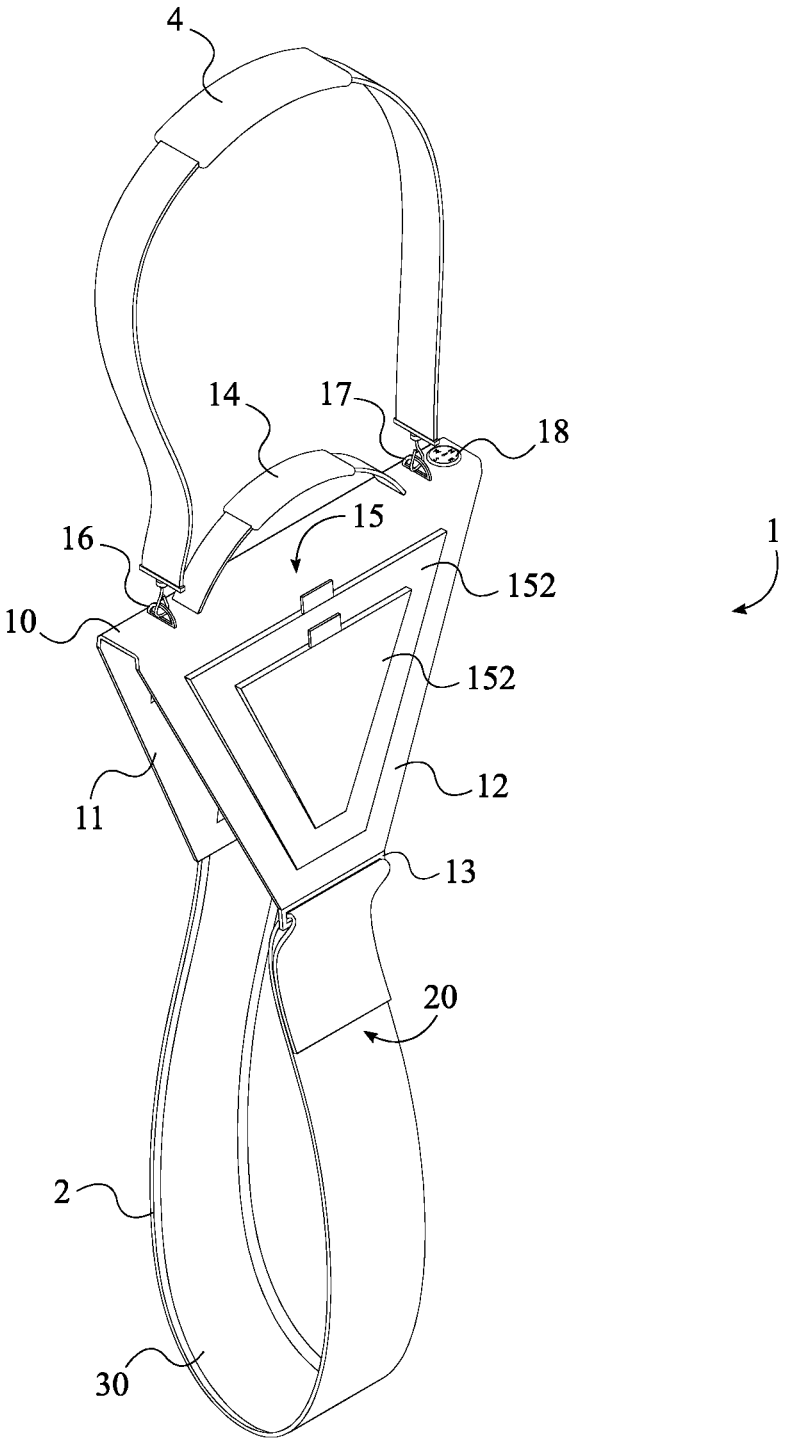
FIG. 5 is a perspective view wherein the carrier strap is attached to the carrier body via the first strap fastener and the second strap fastener both being loops.

The carrier strap 4 can be used in place of or in conjunction with the handle 14 to carry the board. While the handle 14 allows the board to be carried by hand, the carrier strap 4 allows the user to carry the board on their shoulder. In reference to FIG. 5, the carrier strap 4 is terminally attached to the central section 10 on opposing ends of the handle 14, such that a closed loop is formed by the carrier strap 4 and the central section 10. Meanwhile, the handle 14 remains accessible between the anchored ends of the carrier strap 4. Similar to the handle 14, the carrier strap 4 comprises a padded section, wherein the padded section of the carrier strap 4 can be slidably adjusted along the length of the carrier strap 4. When not needed, the carrier strap 4 can be readily detached from the carrier body 1.

Figure 6:
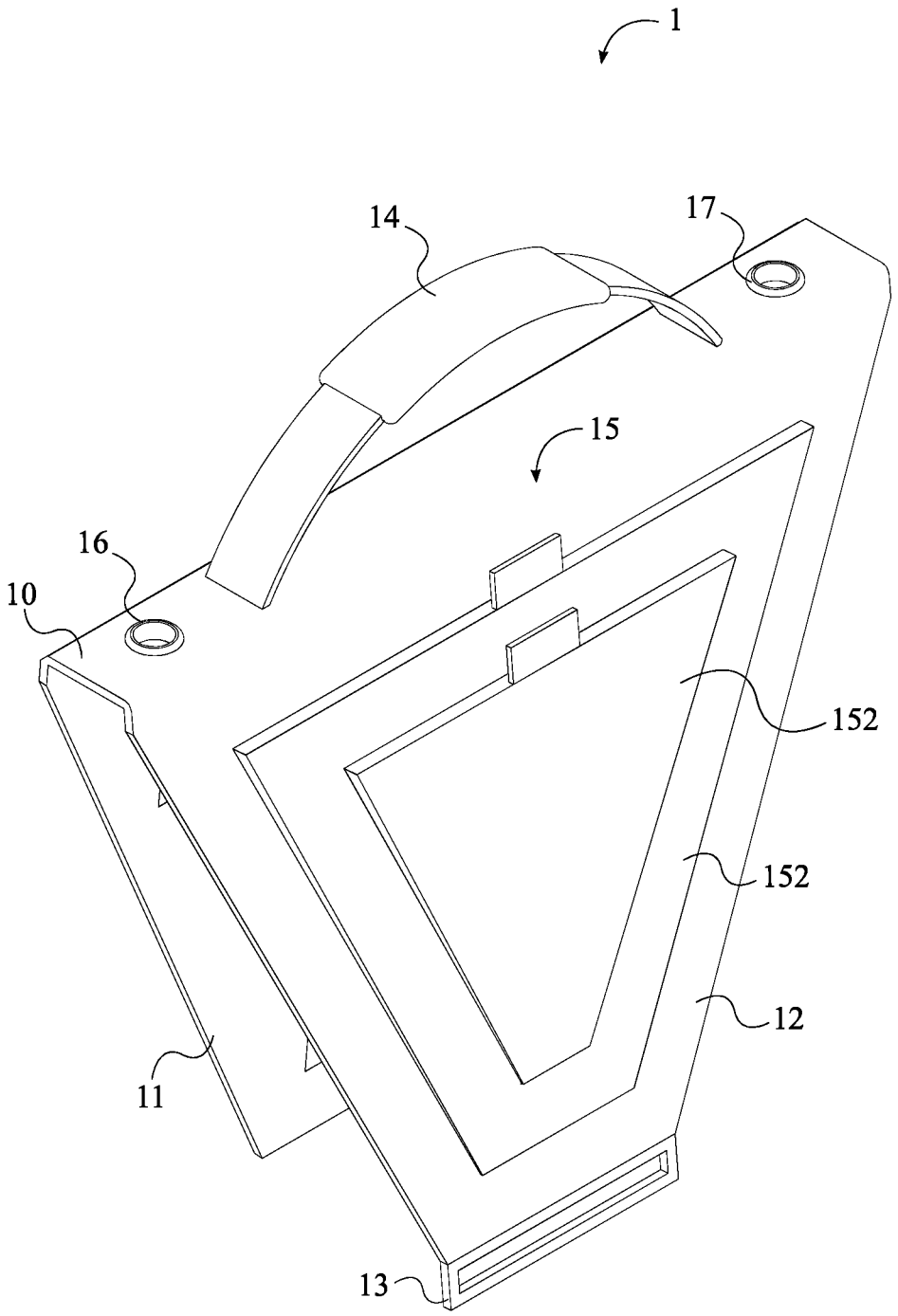
FIG. 6 is a perspective view of the carrier body, wherein the first strap fastener and the second strap fastener are grommets.

The carrier body 1 further comprises a first strap fastener 16 and a second strap fastener 17 that are utilized to anchor the carrier strap 4 to the carrier body 1. The first strap fastener 16 and the second strap fastener 17 are integrated into the central section 10, wherein the handle 14 is positioned in between the first strap fastener 16 and the second strap fastener 17. To attach the carrier strap 4 to the carrier body 1, the carrier strap 4 is removably engaged with the first strap fastener 16 and the second strap fastener 17. In reference to FIG. 6, in one embodiment of the present invention, each of the first strap fastener 16 and the second strap fastener 17 is a hole through the central section 10; more specifically, a grommet. In reference to FIG. 1, in another embodiment, each of the first strap fastener 16 and the second strap fastener 17 is a loop or material connected to the central section 10.

The carrier strap 4 comprises a first connector 41 and a second connector 42, wherein the first connector 41 is removably engaged with the first strap fastener 16 and the second connector 42 is removably engaged with the second strap fastener 17. In the preferred embodiment of the present invention, the first connector 41 and the second connector 42 are each a clip, wherein the first connector 41 and the second connector 42 can be readily attached to and detached from the first strap fastener 16 and the second strap fastener 17 respectively. In other embodiments of the present invention, other suitable mechanical engagements may be formed between the first connector 41 and the first strap fastener 16 and between the second connector 42 and the second strap fastener 17.

Figure 10:
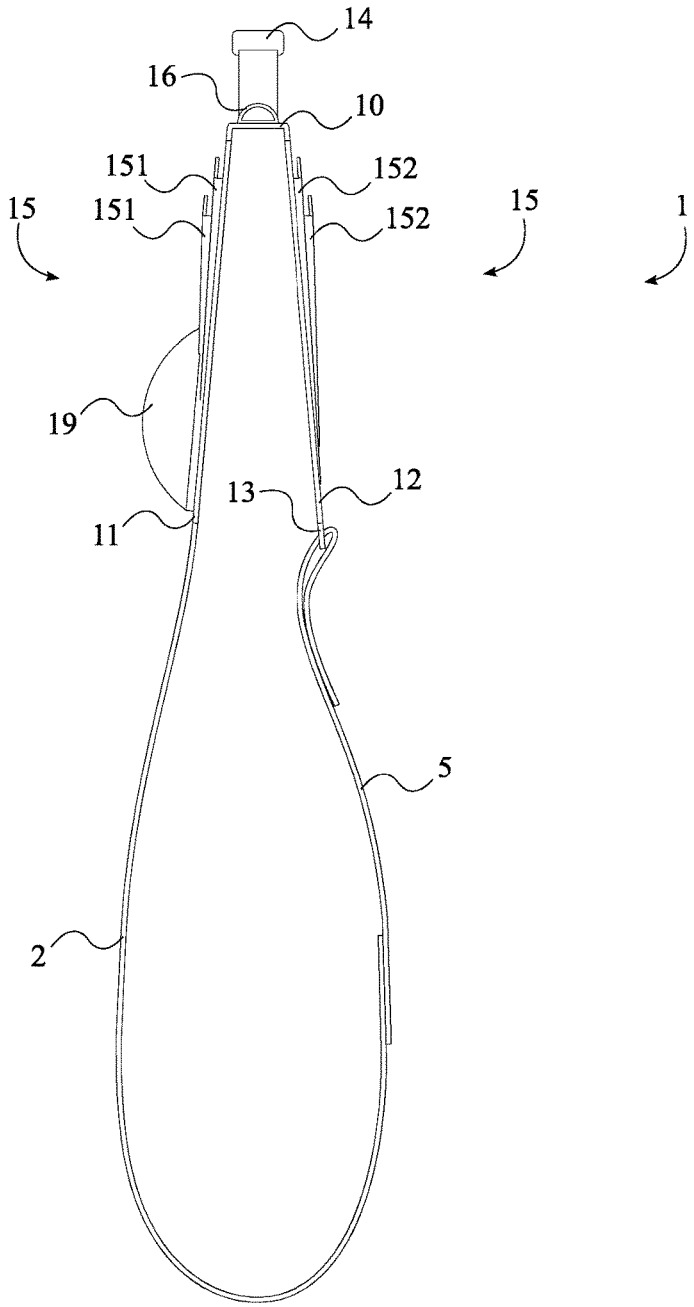
FIG. 10 is a front elevational view, wherein the first extension fastener is engaged with the fastener of the retention strap and the extension strap is secured to the strap fastener via the second extension strap.

If the retention strap 2 is not able to fully encompass the board, then the extension strap 5 can be utilized to provide additional length in order to fully encompass the board. The extension strap 5 is designed to engage with both the retention strap 2 and the strap fastener 13 of the carrier body 1, wherein the extension strap 5 comprises a first extension fastener 51 and a second extension fastener 52. In reference to FIG. 10, the first extension fastener 51 is configured to be removably engaged with the fastener 20 of the retention strap 2, while the second extension fastener 52 is configured to removably secure the extension strap 5 to the strap fastener 13 of the carrier body 1.

Figure 8:
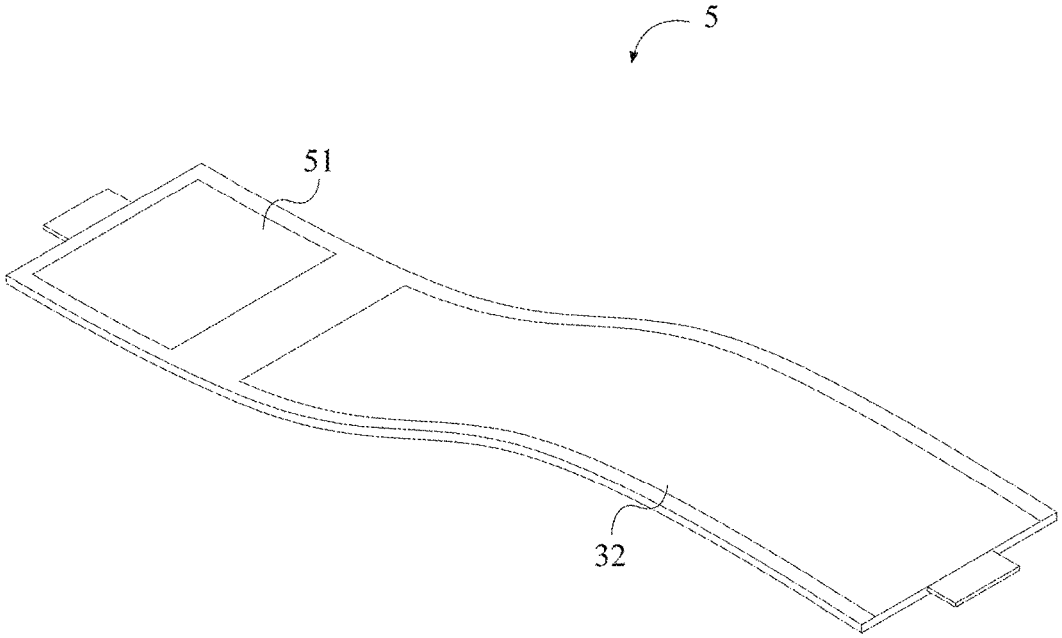
FIG. 8 is a top perspective view of the extension strap, detailing the first extension fastener and the extension strap grip.

In the preferred embodiment of the present invention, wherein the fastener 20 comprises the hook portion 21 and the loop portion 22, the first extension fastener 51 comprises a hook portion 21 and/or a loop portion 22. If used standalone, the hook portion 21 of the first extension fastener 51 or the loop portion 22 of the first extension fastener 51 is positioned along an interior surface of the extension strap 5 as depicted in FIG. 8. If used in conjunction with one another, the hook portion 21 of the first extension fastener 51 and the loop portion 22 of the first extension fastener 51 are positioned adjacent to each other along the interior surface of the extension strap 5. When the first extension fastener 51 is engaged with the fastener 20, the hook portion 21 of the first extension fastener 51 engages with the loop portion 22 of the fastener 20, while the loop portion 22 of the first extension fastener 51 engages with the hook portion 21 of the fastener 20.

Figure 9:
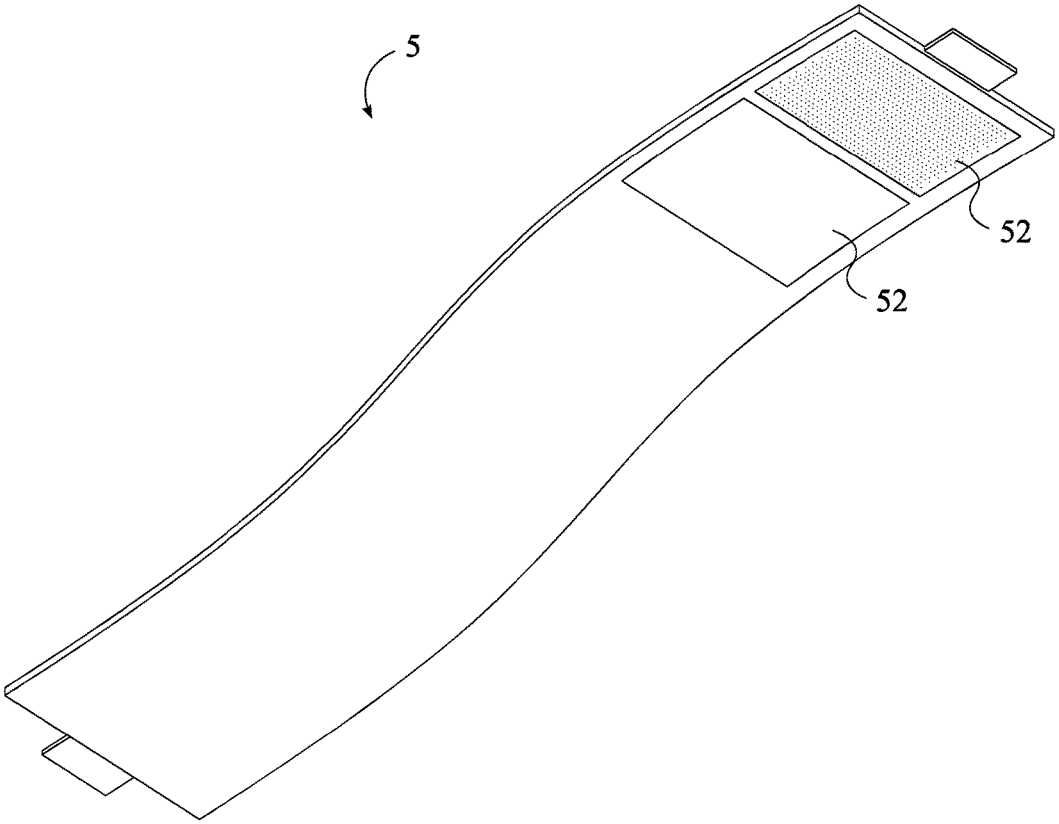
FIG. 9 is a bottom perspective view of the extension strap, detailing the second extension grip.

Furthermore, in the preferred embodiment of the present invention, the second extension fastener 52 comprises a hook portion 21 and a loop portion 22; the hook portion 21 of the second extension fastener 52 and the loop portion 22 of the second extension fastener 52 being positioned adjacent to each other along an exterior surface of the extension strap 5 as depicted in FIG. 9. When the first extension fastener 51 is engaged with the fastener 20, the extension strap 5 is positioned through the strap fastener 13, wherein the hook portion 21 of the second extension fastener 52 is engaged with the loop portion 22 of the second extension fastener 52, securing the extension strap 5 to the strap fastener 13, and in turn the second flap 12.

The plurality of grips 3 further comprises an extension strap grip 32 that is integrated into the extension strap 5, wherein the extension strap grip 32 is configured to engage with the board. More specifically, the extension strap grip 32 is integrated into the interior surface of the extension strap 5 as depicted in FIG. 8. When the extension strap 5 is positioned about the board, the interior surface of the extension strap 5 is positioned adjacent to the board, wherein the extension strap grip 32 engages with the board. Similar to the strap grip 30 and the carrier grip 31, the extension strap grip 32 prevents the board from slipping when the board is carried.

The plurality of pockets 15 allows the user to store and transport various objects within the carrier body 1. For example, the plurality of pockets 15 can be used to store keys, wallets, phones, snacks, etc. The plurality of pockets 15 is integrated into the first flap 11 and the second flap 12, such that storage space is provided on both sides of the carrier body 1. As the present invention is used around bodies of water, each of the plurality of pockets 15 is waterproof in order to protect the contents stored within the plurality of pockets 15. In the preferred embodiment of the present invention, each of the plurality of pockets 15 is secured closed using hook and loop fasteners, wherein a pull tab is also provided for each of the plurality of pockets 15 in order to open the plurality of pockets 15.

Furthermore, in the preferred embodiment of the present invention, the plurality of pockets 15 comprises a first pair of pockets 151 and a second pair of pockets 152. The first pair of pockets 151 is integrated into the first flap 11 as depicted in FIG. 3, while the second pair of pockets 152 is integrated into the second flap 12 as depicted in FIG. 2. The first pair of pockets 151 has an innermost pocket and an outermost pocket, wherein the outermost pocket is stacked on top of the innermost pocket. Similarly, the second pair of pockets 152 has an innermost pocket and an outermost pocket, wherein the outermost pocket of the second pair of pockets 152 is stacked on top of the innermost pocket of the second pair of pockets 152.

The carrier body 1 may further comprise a compass 18 and a media unit 19. In reference to FIG. 1, the compass 18 is integrated into the central section 10 and is positioned adjacent to the handle 14. The compass 18 allows the user to readily view the cardinal direction in which the user is oriented. In reference to FIG. 3, the media unit 19 is integrated into the first flap 11 and allows the user to view data such as the time, weather, swell height, swell direction, tide, weather watches and warnings, tsunami watches and warnings, location data (e.g. global positioning system [GPS] coordinates), etc.

The media unit 19 comprises a transceiver, a microcontroller, and a display screen. The transceiver is used to connect with wireless networks in order to retrieve the desired information. Signals received by the transceiver are sent to and processed by the microcontroller. The microcontroller then dictates the information that is presented to the user through the display screen. The media unit 19 may further comprise one or more controls used to select the information that is presented on the display screen. Alternatively, the display screen may be a touch screen.

Although the invention has been explained in relation to its preferred embodiment, it is to be understood that many other possible modifications and variations can be made without departing from the spirit and scope of the invention as hereinafter claimed.

What is claimed is:

1. A board carrier comprising:
a carrier body;
a retention strap;
a carrier grip;
a retention grip;
a carrier strap;
the carrier body comprising a central section, a first flap, a second flap, a carrier fastener, a handle, two strap fasteners and a compass;
the retention strap comprising an intermediate section, a first end, a second end and a retention fastener;
the first flap and the second flap each being connected to the central section;
the central section being connected in between the first flap and the second flap;
the handle being connected to the central section;
the two strap fasteners being integrated into the central section;
the handle being located in between the two strap fasteners;
the carrier strap being removably engaged with the two strap fasteners;
the compass being integrated into the central section;
one of the two strap fasteners being located in between the handle and the compass;
the carrier fastener being connected to the second flap;
the second flap being connected in between the carrier fastener and the central section;
the first end and the second end each being connected to the intermediate section;
the intermediate section being connected in between the first end and the second end;
the retention fastener being disposed on the second end;
the first flap and the first end being connected to each other;
the second flap and the second end being removably engaged with each other by the carrier fastener and the retention fastener being removably engaged with each other;
the carrier grip being integrated into the carrier body;
the retention grip being integrated with the retention strap; and
the carrier grip and the retention grip each being configured to engage with a board.

2. The board carrier as claimed in claim 1 comprising:
the carrier body comprising a plurality of pockets; and
the plurality of pockets being integrated into the first flap and the second flap.

3. The board carrier as claimed in claim 2, wherein each of the plurality of pockets is waterproof.

4. The board carrier as claimed in claim 2 comprising:
the plurality of pockets comprising a first pair of pockets and a second pair of pockets;
the first pair of pockets being integrated into the first flap; and
the second pair of pockets being formed into the second flap.

5. The board carrier as claimed in claim 1 comprising:
the carrier body comprising a media unit; and
the media unit being integrated into the first flap.

6. The board carrier as claimed in claim 1 comprising:
the retention fastener comprising a hook portion and a loop portion;
the hook portion and the loop portion being disposed on the second end; and
the hook portion and the loop portion being removably engaged with each other.

7. The board carrier as claimed in claim 6 comprising:
the second flap and the second end being engaged with each other in response to the second end passing through the carrier fastener and the hook portion and the loop portion being engaged with each other.

8. The board carrier as claimed in claim 1 comprising:
the strap grip being positioned along the retention strap.

9. The board carrier as claimed in claim 1 comprising:
the carrier grip being positioned about the carrier body.

10. The board carrier as claimed in claim 1 comprising:

an extension strap;

the extension strap comprising a first extension fastener and a second extension fastener;

the first extension fastener being removably engaged with the retention fastener; and the second extension fastener being removably engaged with the carrier fastener.

11. The board carrier as claimed in claim 10 comprising:

an extension grip;

the extension grip being integrated with the extension strap; and the extension grip being positioned along the extension strap.

* * * * *